US007421085B2

(12) United States Patent
Husung et al.

(10) Patent No.: US 7,421,085 B2
(45) Date of Patent: Sep. 2, 2008

(54) HEARING AID DEVICE OR HEARING DEVICE SYSTEM WITH A CLOCK GENERATOR

(75) Inventors: Kunibert Husung, Erlangen (DE); Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 471 days.

(21) Appl. No.: 10/675,304

(22) Filed: Sep. 30, 2003

(65) Prior Publication Data

US 2004/0109577 A1 Jun. 10, 2004

(30) Foreign Application Priority Data

Sep. 30, 2002 (DE) ..... 102 45 556

(51) Int. Cl.
*H04R 25/00* (2006.01)

(52) U.S. Cl. ..... 381/312; 381/315

(58) Field of Classification Search ..... 381/312–315, 381/320–321, 331, 317–318; 375/217, 226, 375/296–297, 326–327, 371, 373
See application file for complete search history.

(56) References Cited

U.S. PATENT DOCUMENTS 3,781,695 A * 12/1973 Jackson ..... 327/159
4,818,950 A * 4/1989 Ranger ..... 327/157
4,862,485 A * 8/1989 Guinea et al. ..... 375/376
5,535,067 A * 7/1996 Rooke ..... 360/51
5,721,783 A 2/1998 Anderson
6,329,929 B1 * 12/2001 Weijand et al. ..... 340/870.25
2002/0196887 A1 * 12/2002 Heikkila ..... 375/371
2003/0210029 A1 * 11/2003 Antheunisse et al. ..... 324/76.53
2004/0066944 A1 * 4/2004 Leenen et al. ..... 381/314
2004/0247148 A1 * 12/2004 Pedersen ..... 381/323

FOREIGN PATENT DOCUMENTS

DE 693 27 951 T2 8/2000
WO WO 93/20668 10/1993

* cited by examiner

*Primary Examiner*—Curtis Kuntz
*Assistant Examiner*—Phylesha L Dabney
(74) *Attorney, Agent, or Firm*—Schiff Hardin LLP

(57) ABSTRACT

Due to the clocked mode of operation, electromagnetic interference signals originate from digital hearing aid device or hearing device systems with the clock frequency and its harmonics. These can disrupt the wireless signal transmission between the hearing aid device or hearing device system and a further device. To prevent these disruptions, the invention provides a jitter unit that is connected with the clock generator and causes frequency oscillations in the clock signal. The interference signals caused by the clock signal are thereby lowered with respect to their amplitudes, whereby an interference-free signal transmission is enabled between a transmitting and/or receiving unit connected with a hearing aid device and an external device.

14 Claims, 3 Drawing Sheets

HEARING AID DEVICE OR HEARING DEVICE SYSTEM WITH A CLOCK GENERATOR

BACKGROUND OF THE INVENTION

The invention concerns a hearing aid device or hearing device system, as well as a method to operate a hearing aid device or hearing device system, with at least one input transducer to acquire an input signal and transduce it into an electrical signal, an A/D converter to convert the electrical input signal into a digital signal, a digital signal processing unit to process the digital signal, a clock generator to generate a clock signal to control the digital signal processing unit, an output transducer, and a transmitting and/or receiving unit for wireless signal transmission between the hearing aid device or hearing device system and a further device.

A modern hearing aid device offers the possibility for wireless signal transmission between the hearing aid device and a further device, for example, a further hearing aid device, a programmer device, or an external transmission and receiving device. To transmit and/or receive, the hearing aid device comprises a transmitting and/or receiving unit.

However, hearing device systems with a hearing aid device and a transmitting and/or receiving unit are also known in which the transmitting and/or receiving unit is fashioned as an independent modular unit, preferably fashioned external to the hearing aid device, that is detachably connected with the hearing aid device to transmit or, respectively, receive. The transmitting and/or receiving unit is then preferably attached to the hearing aid device and is electrically connected with it by via contacts and conductors. Yet, it is also possible that the transmitting and/or receiving unit is not directly attached to the hearing aid device, but rather is carried on the body or the clothing of a hearing device user as a separate device. The connection to the hearing aid device then exists only via electrical contacts and conductors.

The transmitting and/or receiving units of the appertaining devices are frequently fashioned as "FM systems", such that the transmitted signal is frequency-modulated. However, a modulation of the transmitted signal is not necessarily required, and is also not limited to a frequency modulation.

A hearing device with a processor located removed from the hearing device is known from U.S. Pat. No. 5,721,783 which comprises a wireless connection between the hearing device and the processor.

A hearing device is known from German patent document no. DE 693 27 951 T2 in which, among other things, a digital noise signal is added to the microphone signal for comparison of acoustic feedbacks.

In modern hearing aid devices, the signal processing ensues digitally. To control the digital circuits necessary for this, a clock signal is required. The clock signal of a digital hearing aid device is, for the most part, not very stable. Oscillator quartzes to stabilize the clock generator can not be used, due to their size. Consequently, the clock frequency is slightly dependent on temperature and supply voltage. It is therefore only quasi-stable. Nevertheless, the clock signal can also be regarded in a hearing aid device for a period of consideration of a few minutes as a uniform, stable signal with constant period duration and pulse width.

Due to the clocked operation of the hearing aid device, an electromagnetic noise signal in time with this clock frequency outputs from the hearing aid device and in particular from a clocked output stage. Furthermore, noise signals also ensue in multiples of this clock signal, also called overtones or harmonics. The receiver unit of the hearing aid device or hearing device system might detect a signal caused by overtones although no real receiver signal is present for the receiver unit. The frequency band in which the receiver signal lies is normally selected such that no harmonics of the clock frequency ensue within it. A slowly drifting clock frequency of the clock generator can then lead thereto that harmonics of the clock frequency lie within the frequency band of the receiver signal. The reception by the receiver unit is thereby disrupted.

Previously, it was widely, inadequately tried via elaborate filter stages to eliminate or, respectively, to localize in the hearing aid device narrow-band noise components already existing in the hearing device, that in particular extend into the frequency range of some 100 MHz via the harmonic components of the output clock frequency. Nevertheless, a high-frequency emission is not completely prevented, which leads in part to disruptions in the operation of a receiver unit. Furthermore, suitable shielding measures at the hearing aid device result in a remedy with regard to this high-frequency emission. However, all cited measures are very elaborate and expensive.

SUMMARY OF THE INVENTION

It is therefore the object of the present invention to prevent, in a simple and cost-effective manner, electromagnetic interference signals at multiples of the clock frequency of a hearing aid device.

This object is achieved via a method to operate a hearing aid device or hearing device system with at least one input transducer to acquire an input signal and transduce it into an electrical signal, an A/D converter to convert the electrical input signal into a digital signal, a digital signal processing unit to process the digital signal, a clock generator to generate a clock signal to control the digital signal processing unit, an output transducer, and a transmitting and/or receiving unit for wireless signal transmission between the hearing aid device or hearing device system, and a further device, whereby frequency oscillations are generated in the clock signal that originates from the clock generator.

Furthermore, the object is achieved by a hearing aid device or hearing device system with at least one input transducer to acquire an input signal and transduce it into an electrical signal, an A/D converter to convert the electrical input signal into a digital signal, a digital signal processing unit to process the digital signal, a clock generator to generate a clock signal to control the digital signal processing unit, an output transducer, and a transmitting and/or receiving unit for wireless signal transmission between the hearing aid device or hearing device system, and a further device, whereby a jitter unit is associated with the clock generator to generate frequency oscillations in the clock signal.

The hearing aid device according to the invention is a hearing aid device wearable behind the ear, a hearing aid device wearable in the ear, an implantable hearing aid device, or a pocket hearing aid device. Furthermore, the hearing aid device according to the invention can also be a part of hearing device system comprising a plurality of devices to assist a person hard of hearing, for example part of a hearing device system with two hearing aid devices worn on the head for binaural supply, part of a hearing device system with a hearing aid device worn on the head and an external processor unit wearable on the body, part of a wholly or partially implantable hearing device system with a plurality of components, part of a hearing device system with external additional components such as remote control unit or external microphone unit, and so forth.

A hearing aid device comprises, as a rule, one or more input transducers to acquire an input signal. The input transducer is, for example, fashioned as a microphone that acquires an acoustic signal and transduces it into an electrical signal. However, units that comprise a coil or an antenna and that acquire an electromagnetic signal and convert it into an electrical signal are also used as an input transducer.

Furthermore, a hearing aid device typically comprises a signal processing unit for processing and frequency-dependent amplification of the electrical signal. A preferably digital signal processor (DSP) provides signal processing in the hearing aid device whose mode of operation can be influenced using programs or parameters that can be transmitted to the hearing aid device. The mode of operation of the signal processing unit is thereby adapted both to the individual hearing loss of a hearing device user and to the current auditory situation in which the hearing aid device directly operates. The thusly changed electrical signal is finally supplied to an output transducer. As a rule, this is fashioned as an earpiece that transduces the electrical output signal into an acoustic signal. However, here other embodiments are also possible, for example, an implantable output transducer that is directly connected with an ossicle and excites this to oscillations.

The hearing aid device according to the invention can comprise a transmitting and/or receiving unit for wireless signal transmission between the hearing aid device and a further device. However, it can also be part of a hearing device system with at least one hearing aid device and a transmitting and/or receiving unit that is arranged as an independent modular unit external to the housing of the hearing aid device.

To operate a digital hearing aid device with a digital signal processing unit and a digital output, a clock generator is necessary that outputs a clock signal with predefined properties. The invention provides that the clock signal is destabilized in limited extent, i.e., changes also ensue in the clock signal over a short period under observation of a few seconds. It can, for this reason, not be considered as a periodic cycle of successive, identical clock pulses.

Different possibilities are available to change the clock signal. For example, the period duration can oscillate, or the pulse width can vary. Furthermore, the edge steepness of the clock pulse can be subjected to momentary oscillations.

The destabilization of the clock signal leads to the fact that both the energy portion of the noise signals generated in the hearing aid device are divided with the clock frequency and their harmonics are spread over a larger frequency band, and thus the frequency-specific energy is less. This means in turn that, given correspondingly measured oscillations of the clock signal, the amplitude of a noise signal caused by the harmonics lies below the receiving threshold of the receiver unit. Harmonics of the clock frequency therefore no longer lead to interferences in the wireless reception of a signal from an external device. Overall, the invention offers the advantage that a hearing aid device, in connection with a signal transmission system for wireless signal transmission, enables a noise-free communication.

An embodiment of the invention provides a jitter unit by which minor frequency oscillations (frequency jitters) are applied to the clock signal. To generate the frequency oscillations in the clock signal, a stable internal clock signal of the clock generator is preferably modulated with a further signal, i.e., superimposed with a further signal. The modulation preferably ensues with a sine or noise signal, whereby its frequency components preferably lie clearly above the audio frequency range, and for this reason cause in it no additional distortion or amplified noises. The signal modulated with the internal clock signal is preferably selected such that the frequency of the existing clock signal oscillates around an average frequency. Furthermore, this average frequency can for this purpose be considered as the clock frequency of the system, where the real clock frequency then lies in sliding transition for some periods over the average frequency and for some periods below the average frequency. The frequency of the clock oscillations preferably lies over the audible audio frequency range such that the clock oscillations do not lead to audible distortions in the output signal of the hearing aid device.

DESCRIPTION OF THE DRAWINGS

Further details of the invention arise from the subsequent specification of an exemplary embodiment illustrated by the figures.

DETAILED DESCRIPTION OF THE PREFERRED EMBODIMENTS

Figure 1:
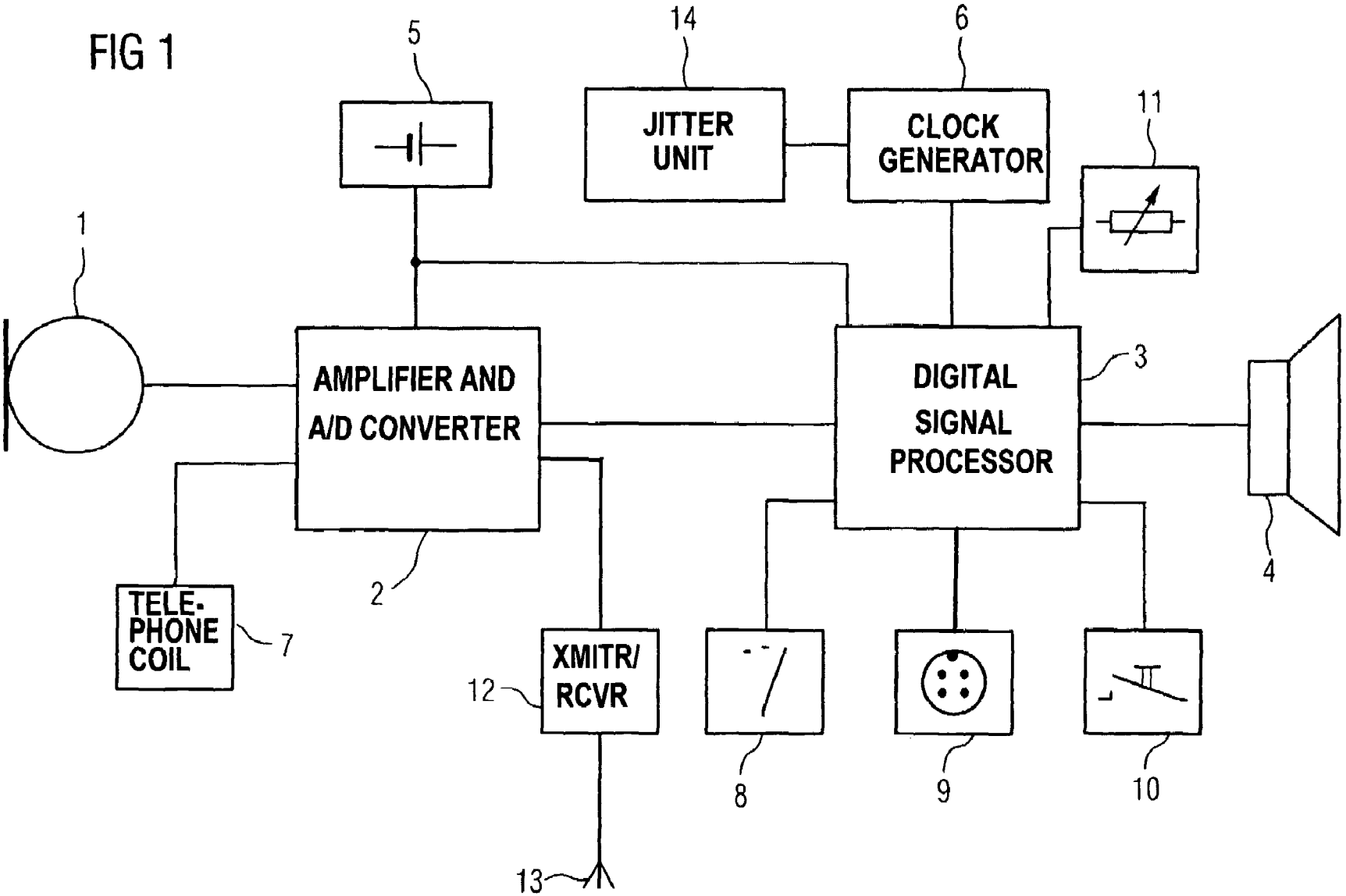
FIG. 1 is a block diagram of a digital hearing aid device with a jitter unit.

FIG. 1 shows an exemplary embodiment for a hearing aid device according to the invention in a block diagram. A microphone 1 serves to acquire sound that acquires an acoustic input signal and transduces it into an electrical input signal. The electrical input signal is first supplied to a preamplifier and A/D converter unit 2. This transduces the analog input signal into a digital input signal. The digital signal processing unit 3 serves for further processing and frequency-dependent amplification of the digital input signal. This may comprise a class D amplifier for end amplification. Finally, the processed and amplified signal is transduced and output by an earpiece 4 into an analog acoustic output signal. A battery 5 is present for a voltage supply of the hearing device components. Furthermore, the digital signal processing unit of the hearing aid device is connected with a clock generator 6.

In the hearing aid device in the exemplary embodiment according to FIG. 1, in addition to the microphone 1, a telephone coil 7 is provided as a further signal input by which an electromagnetic input signal can be acquired. The hearing aid device further comprises an MTO switch 8 that can be operated by a hearing device user to select the operation via the microphone (switch position M), via the telephone coil (switch position T), or to switch the hearing aid device off (switch position O). Moreover, the hearing aid device may comprise a programmer socket 9 for wired connection with a programmer device, as well as a situation button 10 by which the hearing device user switches over between various auditory programs. A VC regulator 11 is present as a further operating element, via which the volume is manually adjusted at the hearing aid device.

For wireless signal transmission between the hearing aid device and a further device, for example, a further hearing aid device, the hearing aid device according to the preferred embodiment of the invention is connected with a transmitting and/or receiving unit 12 that comprises an antenna 13. The transmitting and/or receiving unit 12 can thereby be directly integrated into the housing of the hearing aid device, and thus be part of the hearing aid device. However, the transmitting and/or receiving 12 can also comprise its own housing and, as an independent external modular unit, form a hearing device system together with the hearing aid device. To operate such a hearing device system, an attachment of the external transmitting and/or receiving unit can be provided at the housing of the hearing aid device; however the external transmitting and/or receiving unit can also be carried separately on the body, for example, as a chest or pocket device, and be connected with the hearing aid device only via an electrical connection.

Finally, the hearing aid device may comprise a jitter unit 14 connected with the clock generator 6. The jitter unit 14 effects a frequency jitter of the clock signal originating from the clock generator 6. The frequency jitter can, for example, be caused by the superimposition of a stable internal clock signal with a sine signal or with a noise signal. The frequency of the superimposed signal preferably lies above the audio frequency range such that no perceptible interferences exist in the output signal of the hearing aid device due to the superimposition.

These frequency oscillations in the clock signal permit both the energy portion of interference signals to be distributed with the clock frequency and their harmonics to be spread out over a larger frequency band, and thus the frequency-specific energy is less. Furthermore, due to the clocked mode of operation of the hearing aid device, the interference signals caused in the utilized clock frequency and their harmonics can namely be detected by the antenna 13 or the telephone coil 7; however they are now below the input threshold of the transmitting and/or receiving unit 12 or, respectively, of the preamplifier with AID converter 2, and thus no longer lead to interferences in a wanted signal received or output by the transmitting and/or receiving unit or, respectively, the telephone coil 7.

Figure 2:
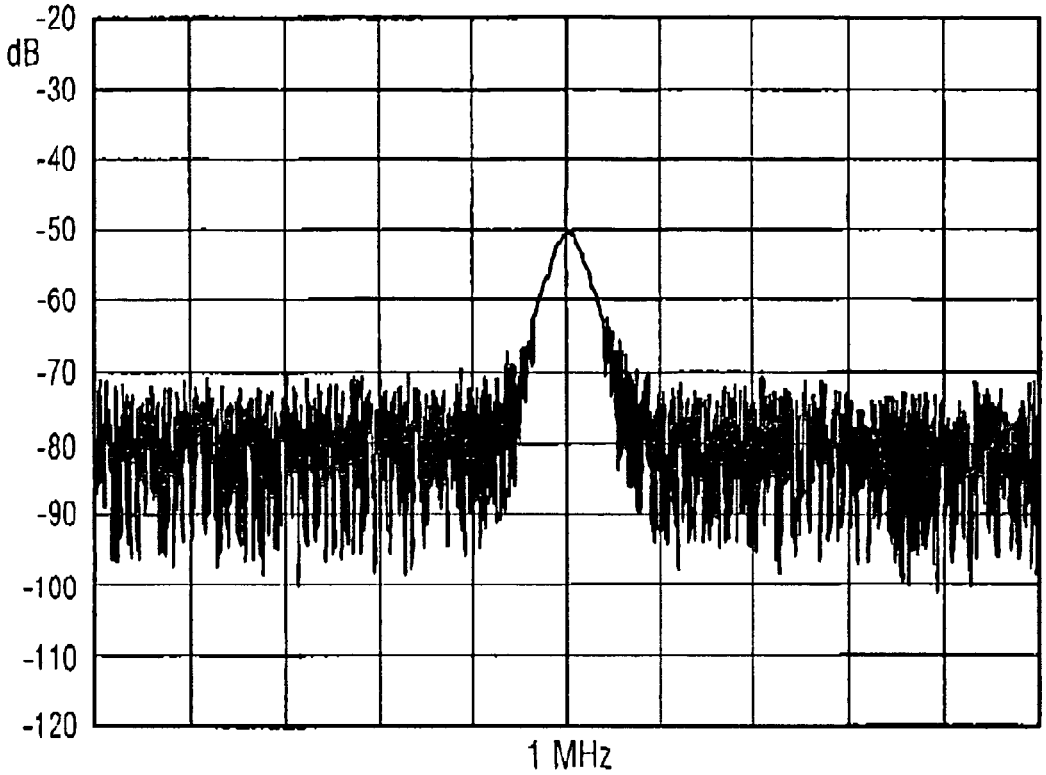
FIG. 2 is a graph illustrating an undisturbed receiver signal.
Figure 3:
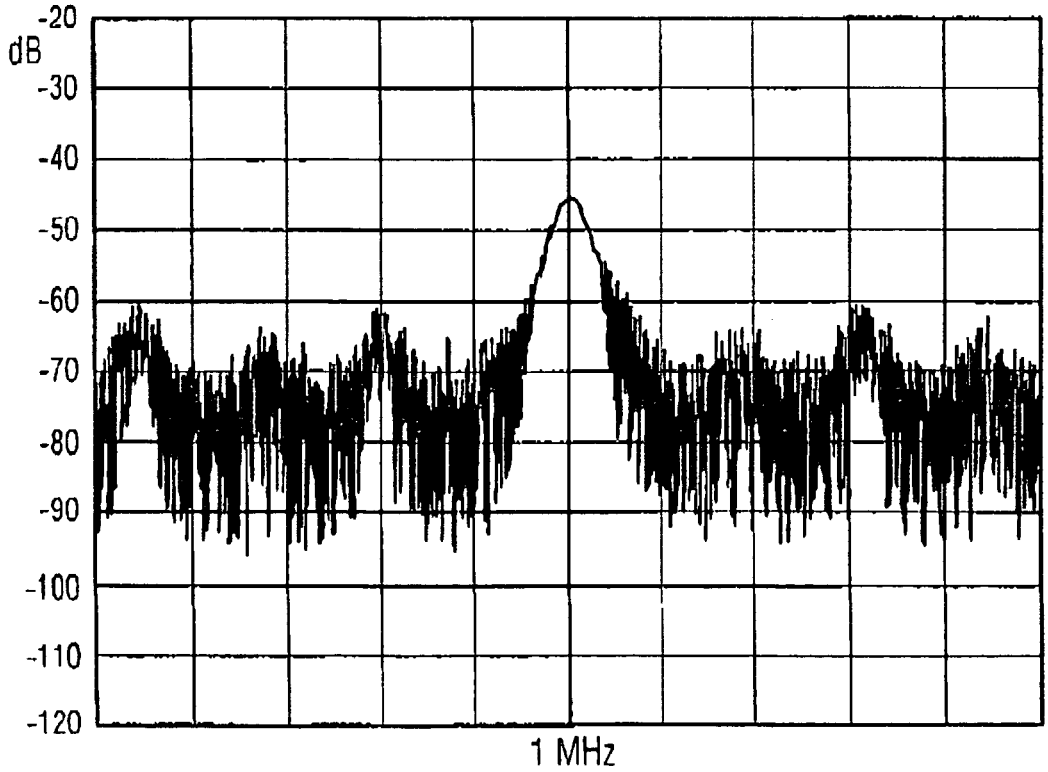
FIG. 3 is a graph illustrating a receiver signal with overlaid interference spectrum.
Figure 4:
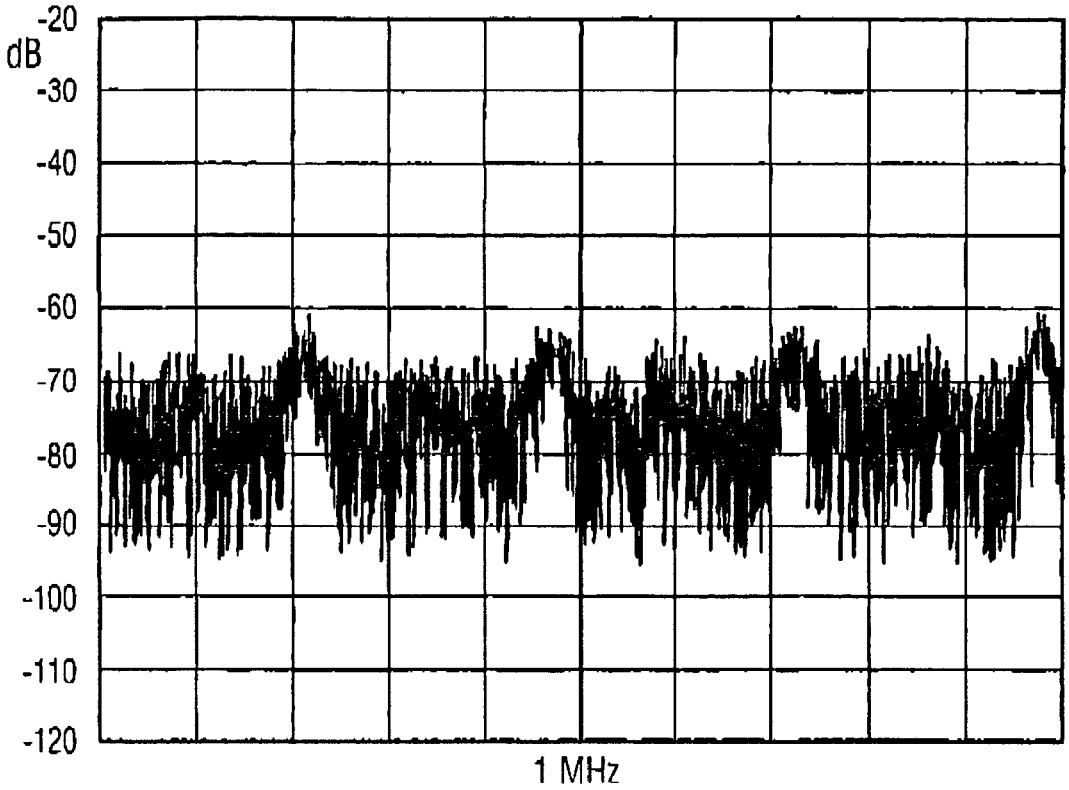
FIG. 4 is a graph illustrating the interference spectrum.
Figure 5:
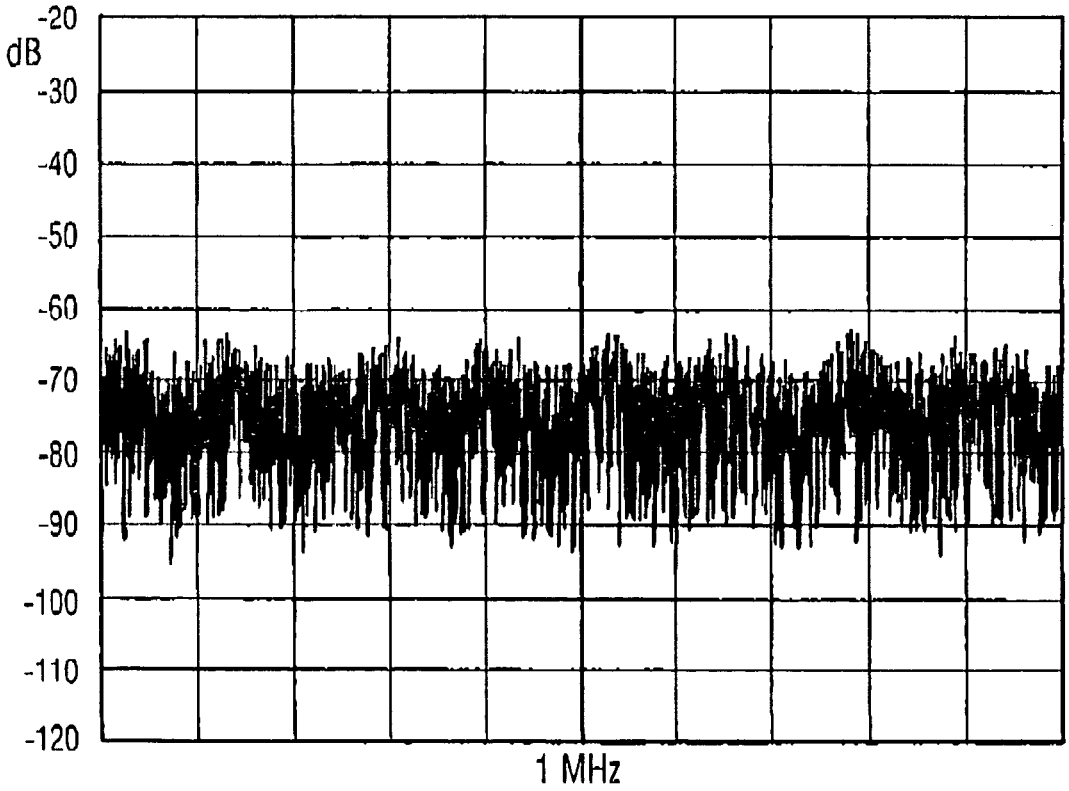
FIG. 5 is a graph illustrating the interference spectrum under the influence of the jitter unit.

FIG. 2 shows the frequency spectrum of an electromagnetic signal with a carrier frequency of 1 MHz acquired by the transmitting and/or receiving unit 12. The received signal according to FIG. 2 is not interfered with by a clock signal, in contrast the signal according to FIG. 3. In this signal, it is clearly visible that an interference signal is superimposed that comprises the harmonics of the clock frequency of the hearing aid device. For clarification, FIG. 4 shows the interference spectrum without the receiver signal. If, in the last cited output situation according to the embodiment of the invention, a frequency jitter is now generated in the clock signal, the interference spectrum is again smoothed, as is illustrated in FIG. 5. The interference signals now once again lie below a receiver threshold of the transmitting and/or receiving unit 12, whereby an interference-free signal transmission is enabled between the hearing aid device and a further device.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

1 microphone
2 amplifier and A/D converter unit
3 digital signal processing unit
4 earpiece
5 battery
6 clock generator
7 telephone coil
8 MTO switch
9 programmer jack
10 situation button
11 VC regulator
12 transmitting and/or-receiving unit
13 antenna
14 jitter unit

What is claimed is:

1. A method for operating a hearing aid device or hearing device system, comprising:

acquiring an input signal with at least one input transducer;

transducing the input signal into an electrical signal with the input transducer;

converting the electrical signal into a digital signal with an A/D converter;

processing the digital signal with a digital signal processing unit;

delivering an output signal with an output transducer;

generating a clock signal with a clock generator to control the digital signal processing unit;

generating frequency jitters in the clock signal originating from the clock generator; and at least one of transmitting and receiving a wireless transmission between the hearing aid device or hearing device system and a further device.

2. The method according to claim 1, further comprising modulating an internal clock signal generated by the clock generator with a further signal to generate the frequency oscillations.

3. The method according to claim 2, wherein the internal clock signal is modulated with a sine signal.

4. The method according to claim 2, wherein the internal clock signal is modulated with a noise signal.

5. The method according to claim 2, wherein the frequency of the further signal lies above an audible frequency range.

6. The method according to claim 1, wherein the frequency of the clock signal oscillates around an average frequency.

7. A hearing aid device or hearing device system, comprising: at least one input transducer configured to acquire an input signal and transduce it into an electrical signal; an A/D converter configured to convert the electrical input signal into a digital signal; a digital signal processing unit configured to process the digital signal; a clock generator configured to generate a clock signal to control the digital signal processing unit; an output transducer and at least one of a transmitting and receiving unit configured to wirelessly transmit between the hearing aid device or hearing device system and a further device; and a jitter unit associated with the clock generator configured to generate jitter oscillations in the clock signal.

8. The hearing aid device or hearing device system according to claim 7, wherein an internal clock signal of the clock generator is modulated with a further signal to generate the frequency oscillations of the clock signal.

9. The hearing aid device or hearing device system according to claim 8, wherein the internal clock system is modulated with a sine signal.

10. The hearing aid device or hearing device system according to claim 8, wherein the internal clock system is modulated with a noise signal.

11. The hearing aid device or hearing device system according to claim 8, wherein the frequency of the further signal lies above the audible frequency range.

12. The hearing aid device or hearing device system according to claim 7, wherein the frequency of the clock signal oscillates around an average frequency.

13. The hearing aid device according to claim 7, wherein at least one of the transmitting unit and the receiving unit is integrated into the hearing aid device.

14. The hearing device system according to claim 7, further comprising a further hearing aid device and at least one of a further external transmitting unit and receiving unit connected with the further hearing aid device.

* * * * *